US012540426B2

(12) United States Patent
Eaton et al.

(10) Patent No.: US 12,540,426 B2
(45) Date of Patent: Feb. 3, 2026

(54) MACHINE SYSTEMS AND METHODS FOR MAKING RANDOM FIBER WEBS

(71) Applicant: 3M INNOVATIVE PROPERTIES COMPANY, St. Paul, MN (US)

(72) Inventors: Warren D. Eaton, St. Paul, MN (US); William P. Klinzing, West Lakeland, MN (US); Jon A. Lindberg, Prairie du Chien, WI (US); David C. Raithel, Hudson, WI (US); Joshua D. Tibbits, Eagan, MN (US); Joseph A. Dunbar, Woodbury, MN (US); Blake R. Griffith, Oakdale, MN (US); Jesse R. Seifert, New Richmond, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 57 days.

(21) Appl. No.: 17/759,101

(22) PCT Filed: Jan. 13, 2021

(86) PCT No.: PCT/IB2021/050228
§ 371 (c)(1),
(2) Date: Jul. 20, 2022

(87) PCT Pub. No.: WO2021/148906
PCT Pub. Date: Jul. 29, 2021

(65) Prior Publication Data

US 2023/0041502 A1 Feb. 9, 2023

Related U.S. Application Data

(60) Provisional application No. 62/964,815, filed on Jan. 23, 2020.

(51) Int. Cl.
*D04H 1/732* (2012.01)
*D01G 15/20* (2006.01)
*D01G 15/46* (2006.01)

(52) U.S. Cl.
CPC ..... *D04H 1/732* (2013.01); *D01G 15/20* (2013.01); *D01G 15/465* (2013.01); *D10B 2509/00* (2013.01)

(58) Field of Classification Search
CPC ..... D01G 15/20; D01G 15/46; D01G 15/465; D01G 15/40; D04H 1/72; D04H 1/732
See application file for complete search history.

(56) References Cited

U.S. PATENT DOCUMENTS 2,890,497 A * 6/1959 Marks ..... D04H 1/72 19/303
3,755,028 A * 8/1973 Wood ..... D04H 5/08 156/62.4

(Continued)

FOREIGN PATENT DOCUMENTS

CA 917873 A 1/1973
CN 101003920 A 7/2007

(Continued)

OTHER PUBLICATIONS

International Search Report for PCT International Application No. PCT/IB2021/050228, mailed on Apr. 12, 2021, 4 pages.

*Primary Examiner* — Aiying Zhao
(74) *Attorney, Agent, or Firm* — Katherine M. Scholz

(57) ABSTRACT

A method of forming a random fiber web using pneumatic fiber feeding system is disclosed. The method includes providing a plurality of moveable apparatuses including a lickerin and a feeder, the lickerin configured to remove a plurality of fibers from a fibrous mat delivered to adjacent the lickerin by the feeder. The method also includes doffing the plurality of fibers from the lickerin at a doffing location (Continued)

within the system. The method also includes communicating an air supply to entrain the plurality of fibers with the air supply after the doffing. The method also includes controlling the air supply within a flow path between the lickerin and a collector. The method also includes collecting the plurality of fibers from the air supply on a collector to form the random fiber web.

9 Claims, 9 Drawing Sheets

(56) References Cited

U.S. PATENT DOCUMENTS 3,768,119 A * 10/1973 Wood ..... D04H 1/72 19/306
3,768,120 A * 10/1973 Miller ..... D04H 1/72 19/306
3,918,126 A 11/1975 Wood
3,972,092 A * 8/1976 Wood ..... D01G 25/00 19/306
4,004,323 A 1/1977 Gotchel et al.
4,064,600 A * 12/1977 Gotchel ..... D04H 1/732 19/306
4,097,965 A * 7/1978 Gotchel ..... D01G 25/00 264/109
4,375,447 A 3/1983 Chung
4,375,448 A 3/1983 Appel et al.
4,388,056 A 6/1983 Lee et al.
4,403,374 A 9/1983 Wood
4,514,880 A 5/1985 Vaughn
4,527,307 A * 7/1985 Teichmann ..... D01G 15/763 19/107
4,640,810 A 2/1987 Laursen et al.
4,769,873 A 9/1988 Pinto
4,927,685 A 5/1990 Marshall
5,076,774 A 12/1991 Farrington
5,569,489 A * 10/1996 Kasmark, Jr. ..... D04H 1/64 427/244
6,223,398 B1 5/2001 Leifeld
6,939,492 B2 9/2005 Jackson et al.
7,476,632 B2 1/2009 Olson et al.
2007/0056674 A1 3/2007 Sellars
2009/0056091 A1 3/2009 Jezzi
2019/0045603 A1 2/2019 Wang
2019/0045604 A1 2/2019 Jonsson et al.

FOREIGN PATENT DOCUMENTS

DE 10321283 A1 * 12/2004 ..... D01G 15/465
JP 54-055673 5/1979
JP H01298219 A 12/1989
JP H05295646 A 11/1993
WO 2020033616 A1 2/2020
WO 2020033617 A1 2/2020

* cited by examiner

PRIOR ART

MACHINE SYSTEMS AND METHODS FOR MAKING RANDOM FIBER WEBS

CROSS REFERENCE TO RELATED APPLICATIONS

This application is a national stage filing under 35 U.S.C. 371 of PCT/IB2021/050228, filed Jan. 13, 2021, which claims the benefit of U.S. Application No. 62/964,815, filed Jan. 23, 2020, the disclosure of which is incorporated by reference in its/their entirety herein.

BACKGROUND

The present disclosure relates to methods, systems and machines for forming random fiber webs. More particularly, it relates to machines, systems and methods for creating non-woven air-laid webs.

In general, various machines, systems and methods are known for making random fiber webs for random fiber articles that are used for various purposes. Cleaning and abrading apparatuses are partially formed of random fiber webs. Additionally, disposable absorbent products such as mortuary, veterinary and personal care absorbent products such as diapers, feminine pads, adult incontinence products, and training pants often include one or more layers of random fiber web materials, especially liquid absorbent fiber web materials.

DETAILED DESCRIPTION

Figure 1:
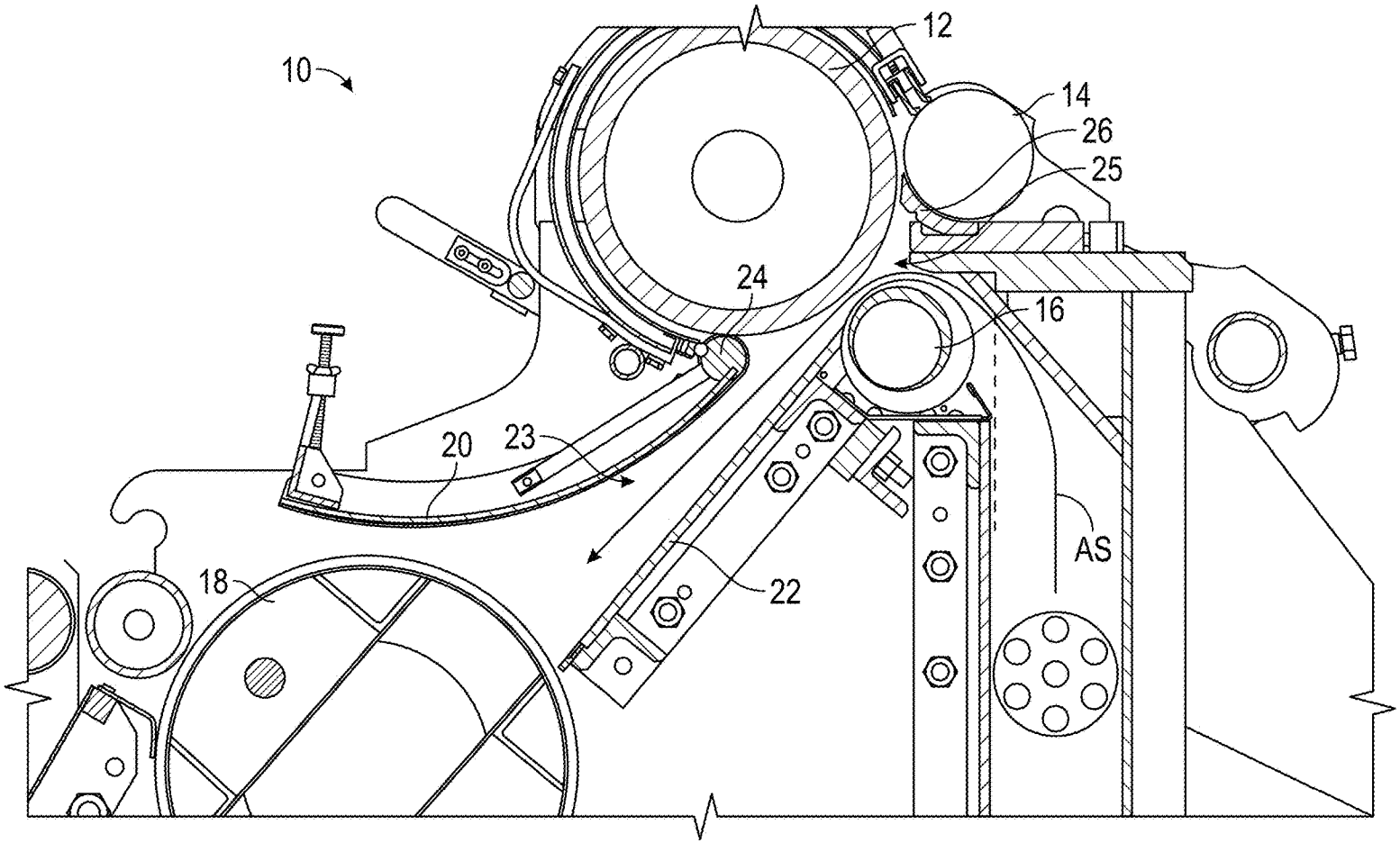
FIG. 1 is a schematic cross-section of a portion of a machine for forming a random fiber web as is known in the prior art.

Aspects of the present disclosure relate to machines, systems and methods for manufacturing random fiber webs.

Aspects of the present disclosure are directed toward machines, systems and methods of making non-woven air-laid webs. One known machine 10 for creating a non-woven air-laid web is shown in reference to FIG. 1. Such machine 10 relies on an initial random fiber mat that is fed to a rotating lickerin 12 such as by a feed roll 14. The lickerin 12 is configured to comb individual fibers from the initial random fiber mat (not shown in FIG. 1). The lickerin 12 then doffs the combed fibers therefrom using centrifugal force and the combed fibers enter an air supply AS flowing past the lickerin 12 and a saber roll 16. The doffed fibers are carried entrained in the air supply (hereinafter AS) to a condenser 18. The fibers are deposited on the condenser 18 in a random fashion to form the non-woven fiber web (not shown in FIG. 1).

Unfortunately, the above described machine often has a non-uniform deposition of the fibers on the condenser 18. This has led to further costly processing steps to create a more uniform web deposition. For example, with the machine of FIG. 1, portions of the non-woven fiber web such as along the cross-web edge regions thereof may be removed due to the non-uniform deposition of the fibers on the condenser 18.

The present inventors have recognized machines which modify the machine of FIG. 1 to provide for a more uniform deposition of the fibers on condenser 18. Such machines reduce processing costs and can reduce the need for further post deposition steps. One realization of the present inventors was the machine of FIG. 1 was doffing an undesirable amount of the combed fibers against one or both of a doffer plate 20 and a lower slide plate 22. These fibers were not being entrained in the air supply AS and clumped together rolling down one or both of the doffer plate 20 and the lower slide plate 22 to the condenser 18. This was suspected as one cause of the non-uniform deposition discussed above. In response, the present inventors propose various solutions, machines and the like, including those with the doffer plate and/or the lower slide plate being removed or having a modified geometry with respect to the machine of FIG. 1.

The present inventors have also realized other components and machine embodiments that allow for an improved more uniform deposition of the fibers on the condenser, which are described herein in brief, and are described in greater detail in PCT Patent Application Ser. No. US2019/045603 (based on U.S. Provisional Patent Application 62/717,069), and in PCT Patent Application Ser. No. US2019/045604 (based on U.S. Provisional Patent Application 62/717,095), both filed Aug. 8, 2019 and both incorporated by reference herein.

These components variously include the addition of a seal having a reverse orientation relative to a direction of rotation of the condenser, one or more ports in a housing of the machine that allow for viewing of the doffing of the fibers and/or lay-up of the fibers on the condenser, addition of a nose bar and/or nose bar extension that changes the doffing point of the fibers into the air stream, the addition of various air venting passages in the housing, a doffer plate and/or the lower slide plate configured to facilitate venting and/or air intake into and/or out of the air supply to name but a few. Further components and machines embodiments are disclosed herein and discussed with reference to the FIGURES.

FIG. 1 illustrates portions of the known machine 10 for forming a random fiber web and has been previously discussed above. In such machine 10, the webs are suitable for producing non-woven fabrics by known chemical or mechanical bonding treatments. For example, dry formed structures may be chemically bonded by known means such as the application of adhesives by spray or by saturation, also bonding may be accomplished by the use of fibers, which can have a low melting point and form a bond to non-adhesive fibers by heat and pressure. Mechanical bonding may be carried out by needling, stitch bonding, print bonding or the like. The quality of any non-woven fabric produced by these finishing methods depends upon the quality and uniformity of the web structure which is to be treated or finished.

Still referring to FIG. 1, the processes described herein can be run at high volume. For example, with the machine 10, doffed fibers can be projected at an initial velocity of up to 5,000 feet per minute by the lickerin 12, which can rotate at the same velocity. Velocities of up to 20,000 feet per minute are not uncommon for the lickerin 12. Doffed fibers can entrain with the air supply AS passing adjacent the lickerin 12. The air supply AS, with the doffed fibers entrained therein, passes from adjacent the lickerin 12 into a chamber 23 that is partially defined by the doffer plate 20 and the lower slide plate 22. These two plates typically have an angle of less than 15° initially. However, the doffer plate 20 and the lower slide plate 22 are angled relative to one another such that the chamber 23 increases in its cross-section from adjacent the lickerin 12 to adjacent the condenser 18. The air supply AS can be controlled so that the doffed fibers are projected into air supply AS with an average velocity of the air flow in the air supply AS being between 0.5 and 1.5 times the initial fiber velocity. The doffed fibers are preferably projected onto the condenser 18 at a rate of between 3 and 30 pounds per hour per inch of machine width or air flow width, although the machine 10 can be suitable for slower and higher rates of operation. Large volumes of air are typically used as the air supply AS to convey the doffed fibers to the condenser 18. Operating with 20 to 30 times weight of air to weight of fiber processed per unit of time, at standard conditions of density and temperature (0.075 lbs. per cu. ft. at 70° F. and 29.92" Hg) is typical.

It is desired that the air supply AS have uniform velocity, low turbulence, with a stable air stream, free from vorticities, in the direction of movement of the lickerin 12. Unfortunately, such is not always the case with machine 10. It was previously thought with the design of the channel/chamber that convey the air supply AS should be shaped to create a venturi in the region 25 adjacent the lickerin 12 where the fibers are doffed upstream of the chamber 23. Furthermore, a boundary layer which is formed around the surface of the lickerin 12 can be interrupted by the use of a doffing bar 24, which is situated adjacent the chamber 23 at a point of maximum shear just below the lickerin 12 at the start of the chamber 23 (sometimes called the expansion chamber). The doffing bar 24 is configured to provide a controlled low level of turbulence in the air supply AS through which the doffed fibers pass.

A nose bar 26 can be utilized and positioned at a small distance from the surface of the lickerin 12 to provide a narrow passage where the fibers are carried on hooks, projections or pieces of the wire covering or a cylinder surface of the lickerin 12 to a point of projection (called a doffing point or doffing location) into the venturi 25 and the air supply AS. The saber roll 16 can be positioned adjacent the nose bar 26 and the lickerin 12 and can be positioned in and adjacent the air supply AS. The saber roll 16 can be journaled for eccentric movement in the side housings of the machine 10. The saber roll 16 spreads the flow of the air supply AS and aids in doffing the fibers from the lickerin 12. The eccentric mounting of the saber roll 16 allows of varying the space between the lickerin 12 and the saber roll 16 so as to restrict the air supply AS to the doffing location.

As discussed above, the present inventors have recognized components which modify the machine 10 of FIG. 1 to provide for a more uniform deposition of the fibers on the condenser. More particularly, the present inventors recognized with the machine 10 of FIG. 1, the doffing location and doffing trajectory is undesirable, and typically leads to a non-uniform deposition of the fibers on the condenser 18 due to at least some of the fibers being doffed toward and contacting the doffer plate 20 and/or the lower slide plate 22 and becoming jumbled and entangled together. Furthermore, the present inventors recognized the machine 10 of FIG. 1 is susceptible to turbulent airflow, air flow surges and/or vortices due to factors including a fully enclosed expansion chamber and fully enclosed other portions of a channel that communicates the air supply AS within the machine 10. The use of the venturi 25 at and just after the doffing location was also determined by the present inventors to be unnecessary in all embodiments. The present inventors also recognize modifications to the expansion chamber geometry, and indeed, in some cases elimination or modification of the doffer plate 20 and/or the lower slide plate 22 can be desirable.

Figure 2:
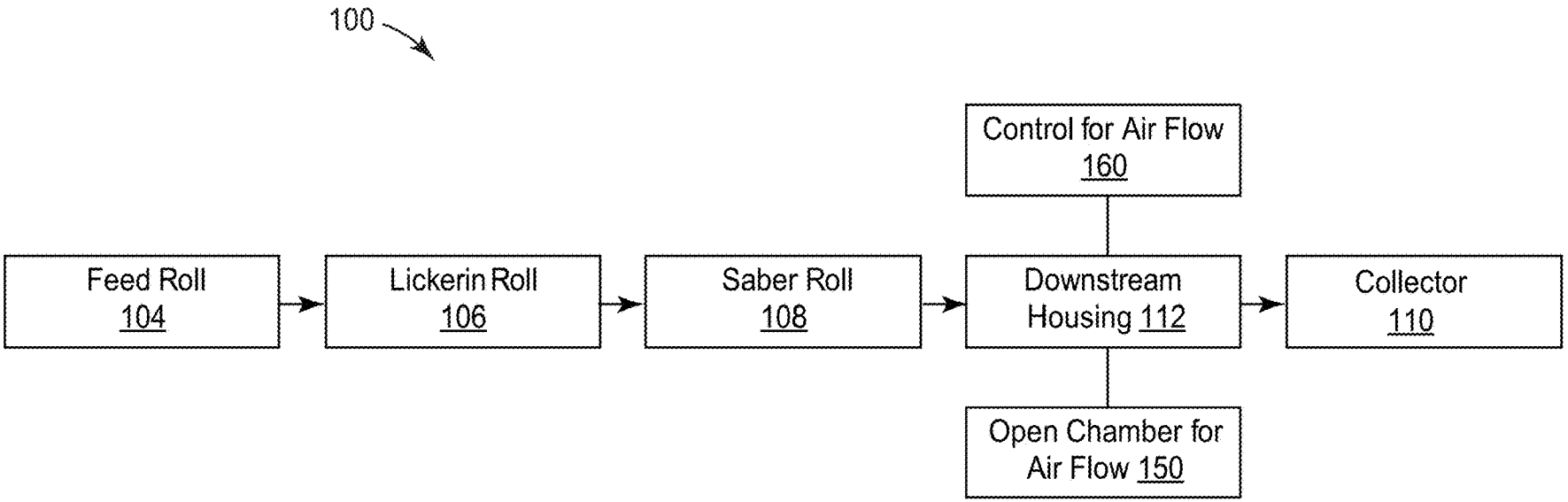
FIG. 2 is a high level schematic diagram tracking some modifications and/or additional components to a system for forming a random fiber web according to an embodiment of the present disclosure.

FIG. 2 shows a highly schematic method 100 of forming a random fiber web using a pneumatic fiber feeding system. The method can include providing a plurality of rotatable rolls. These rotatable rolls can include a feed roll 104, a lickerin roll 106, and a saber roll 108. The term "roll" as used herein is broadly defined to mean any of a moveable, driven or feed type apparatus such as a belt, and is therefore not limited only to rotatable apparatuses such as a roll. The lickerin roll 106 can be configured with hooks, projections and/or other features to remove a plurality of fibers from a fibrous mat delivered to adjacent the lickerin roll 106 by the feed roll 104. The saber roll 108 can be moveably positioned adjacent (within less than an inch to a few inches of) the lickerin roll 106.

The system 100 can include doffing the plurality of fibers from the lickerin roll at a doffing location within a system. The method 100 can further include communicating an air supply to entrain the plurality of fibers with the air supply after the doffing. Additionally, the system 100 can include collecting the plurality of fibers from the air supply to form the random fiber web. Such collection of the fibers can occur at a collector 110 (also call a condenser). The collector can comprise a moveable apparatus such as a roll or belt that can move to gather the laid-up fibers to form the new random fiber web as they fall to the collector 110.

The air supply AS with the plurality of fibers entrained therein can pass through a channel (also called a chamber, space or volume herein) that is downstream (in terms of a direction of flow of the air supply AS) from adjacent the lickerin roll 106 and the saber roll 108. This channel can extend from adjacent the lickerin roll 106 and the saber roll 108 to adjacent the collector 110. The channel can be at least partially defined by a housing 112 (this housing 112 can include the doffer plate, the lower slide plate, and/or the side housings as previously described herein).

As has been previously discussed and will be further discussed herein subsequently, the present inventors have modified system 10 of FIG. 1. FIG. 2 shows just some system and component modifications that the present inventors contemplate. These modifications and components are further described in reference to FIGS. 3-7. Further components and modifications are discussed in co-pending applications PCT Patent Application Ser. No. US2019/045603, and PCT Patent Application Ser. No. US2019/045604, both filed Aug. 8, 2019, the entire disclosures of which are incorporated herein in its entirety.

Specifically, as described in PCT Application Ser. No. US2019/045604, a nose bar assembly can include an extended nose bar between the feed roll 104 and the lickerin roll 106. System 100 can also include providing for an air deflector assembly positioned between the lickerin roll 106 and the saber roll 108. The air deflector assembly can be mounted to a housing of the machine adjacent to the feed roll 104 and can extend into the space to adjacent the lickerin roll 106. System 100 can also include providing a damper 118 adjacent the saber roll 108 to control air flow around the saber roll 108. The system 100 can include providing an airfoil that can be used in lieu of the saber roll 108.

Four other possible additions to the system 100 that can be utilized are described in PCT Patent Application Ser. No. US2019/045603. Such additions can include providing for a nose bar assembly that can include an extended nose bar between the feed roll 104 and the lickerin roll 106. The nose bar assembly can have texturing (i.e. can include surface features such as from carding wires, etc.) in some embodiments. System 100 can include providing for a vent in a saber roll assembly (i.e. a vent between the saber roll 108 and a saber roll end cap that is rotatably mounted in the side housing). The system 100 can include providing one or more viewing ports in the housing 112. These one or more viewing ports can be positioned adjacent the doffing location (e.g., adjacent the lickerin roll 106) and adjacent the collector 110, for example. These viewing ports allow for viewing/monitoring of the doffing of the fibers and/or viewing/monitoring of the fibers as they fall and form the random fiber web on the collector 110, for example. Additionally, system 100 can provide a reverse seal that engages the collector 110 and further is mounted to the lower slide plate. This reverse seal can be shaped to extend from the lower slide plate and can be oriented with a tip that extends in a direction generally opposite of a direction of rotation of the collector 110.

These additions can be utilized together, alone or in various combinations as described in PCT Patent Application Ser. No. US2019/045603. They may also be utilized in combinations, or sub-combinations with the improvements of PCT Patent Application Ser. No. US2019/045604. Further, combinations or sub-combinations of both PCT Patent Application Ser. No. US2019/045603 and PCT Patent Application Ser. No. US2019/045604 may be utilized with the improvements discussed herein.

FIG. 2 illustrates steps 150 and 160, which includes an open chamber 150 for air flow and a control 160 for air flow. In the system of FIG. 1, air flow is provided solely from air supply AS and is collected by a vacuum in collector 110. However, in at least some embodiments described herein, housing 112 is designed to have an open chamber 150 for less restricted air flow. As described above, some problems with the design of FIG. 1 is the tendency for fibers to collide either with doffer plate 20 or lower slide plate 22. A more open chamber 150 within housing 112 allows for less restricted flow, reducing the likelihood of air, or entrained fibers, colliding with components of system 100 between the lickerin roll 106 and collector 110.

Additionally, in some embodiments, air flow control 160 is provided for air from an air supply, such as air supply AS. Air is provided from air supply AS, as illustrated in FIG. 1, between saber roll 16 and lickerin roll 12 and forced down to collector 18. In system 10 there is no additional source of air either to enter or leave the system. This can cause the air flow within the housing to behave in unpredictable ways, often resulting in entrained fibers clumping and resulting in an uneven web. In some embodiments, therefore, static air control is provided, such that air can enter or leave the system from sources other than air supply AS. Additionally, the direction of air flow within housing 112 is at least partially controllable by a dynamic air control mechanism located within the housing.

Figure 3A:
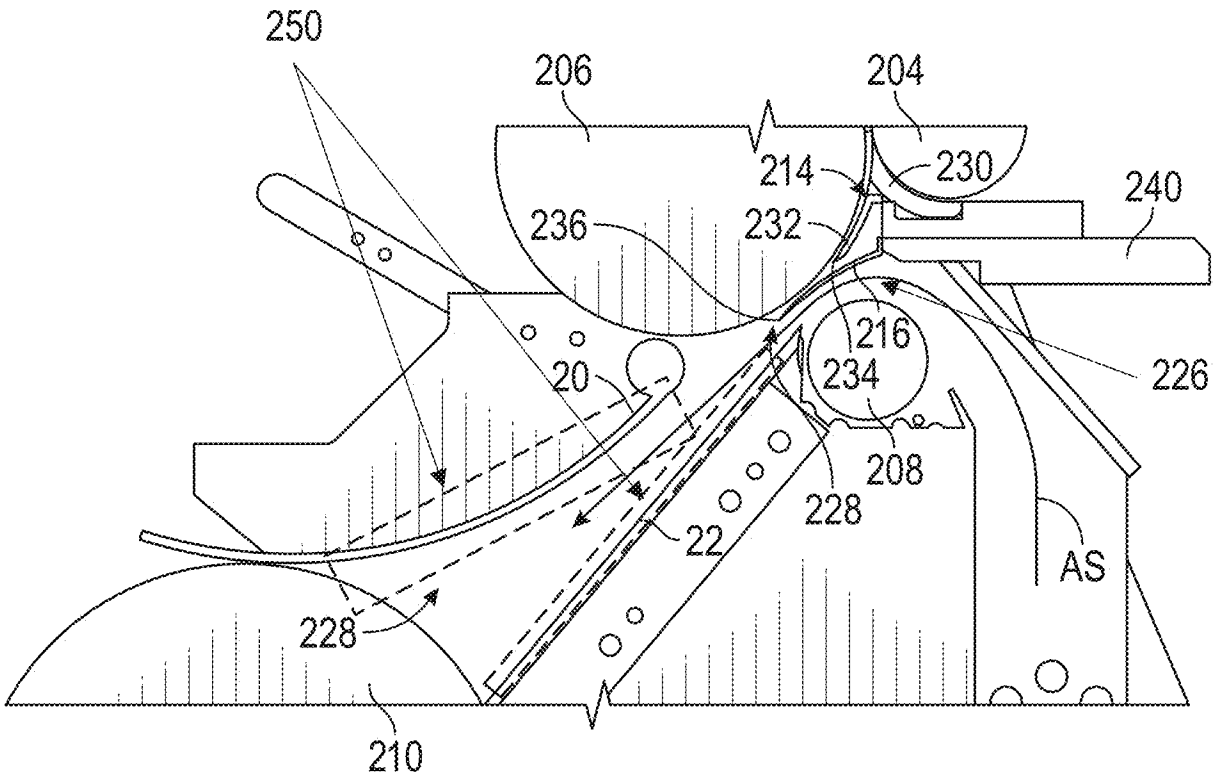
FIGS. 3A and 3B illustrate schematic cross-sections of a portion of a first machine for forming a random fiber web according to an embodiment of the present disclosure.

FIG. 3A shows a machine 220 can include a feed apparatus (e.g., rotatable feed roll 204), a lickerin (e.g., lickerin roll 206) a saber (e.g., the saber roll 208), a channel 226 and the collector 210. The rotatable lickerin roll 206 can be configured to remove a plurality of fibers from a fibrous mat delivered to adjacent the lickerin roll 206 by the feed roll 204. The lickerin roll 206 can be configured to doff the plurality of fibers from the lickerin roll 206. The rotatable saber roll 208 can be positioned adjacent the feed roll 204 and the lickerin roll 206. The channel 226 can communicate the air supply AS to the space 228 defined between the lickerin roll 206 and the saber roll 208. The space 228 can include a doffing location where the doff of the plurality of fibers from the lickerin roll 206 occurs. The rotatable collector 210 can be positioned to capture the plurality of fibers once doffed into the air supply AS. The plurality of fibers, when laid-up, form the random fiber web on the collector 210.

The air deflector assembly 216 can comprise a thin sheet of material that is positioned between the lickerin roll 206 and the saber roll 208. The air deflector assembly 216 can be mounted to a housing portion 240 of the machine 220 adjacent to the feed roll 204 and can extend into the space 228 to adjacent (within less than an inch or less than a few inches) of the lickerin roll 204.

The embodiment of FIG. 3A further shows the nose bar assembly 214 positioned adjacent the lickerin roll 206 and extending along the lickerin roll 206 toward the saber roll 208 for the machine 220. More particularly, the nose bar assembly 214 can include a nose bar 230 and a nose bar extension 232. The nose bar extension 232 and the nose bar 230 can be coupled together, or may be a single component. The nose bar extension 232 can extend along the lickerin roll 206 and toward the saber roll 208.

In the embodiment of FIG. 3A, the nose bar extension 232 can be separated from the space 226 by the air deflector assembly 216, which is positioned between the nose bar extension 232 (and indeed extends between the lickerin roll 206 and the saber roll 208) and the space 226. In FIG. 3A, the air deflector assembly 216 is positioned and configured to deflect the air supply AS away from the nose bar extension 232 and the doffing location (i.e., the location where the plurality of fibers are doffed from the lickerin roll 206). Thus, the doffing location can be located in a second space 234 defined between the lickerin roll 206 and the air deflector assembly 216 adjacent a termination point of the nose bar extension 232. Thus, the doffing location is in the second space 234 and is not directly in the air supply AS in the space 228 due to the presence of the air deflector assembly 216. Put another way, in the embodiment of FIG. 3A, the doffing location is not directly positioned in the air supply AS but is separated therefrom by the air deflector assembly 216.

The nose bar assembly 214 can be positioned at least partially between the feed roll 204 and the lickerin roll 206 and can extend into the second space 234. The nose bar assembly 214 can be positioned adjacent to (within less than an inch or less than a few inches) and can extend around a portion of the circumference of the lickerin roll up to 170 degrees. The nose bar assembly 214, and in particular, the nose bar extension 232 can control the doffing location and trajectory. The nose bar extension 232 can be shaped and positioned such that the doffing location and trajectory is shifted so the plurality of fibers clear the air deflector assembly 216, the doffer plate 20 and/or the lower slide plate 22 and are better positioned to entrain in the air supply AS after passing the end 236 of the air deflector assembly 216.

Figure 3B:
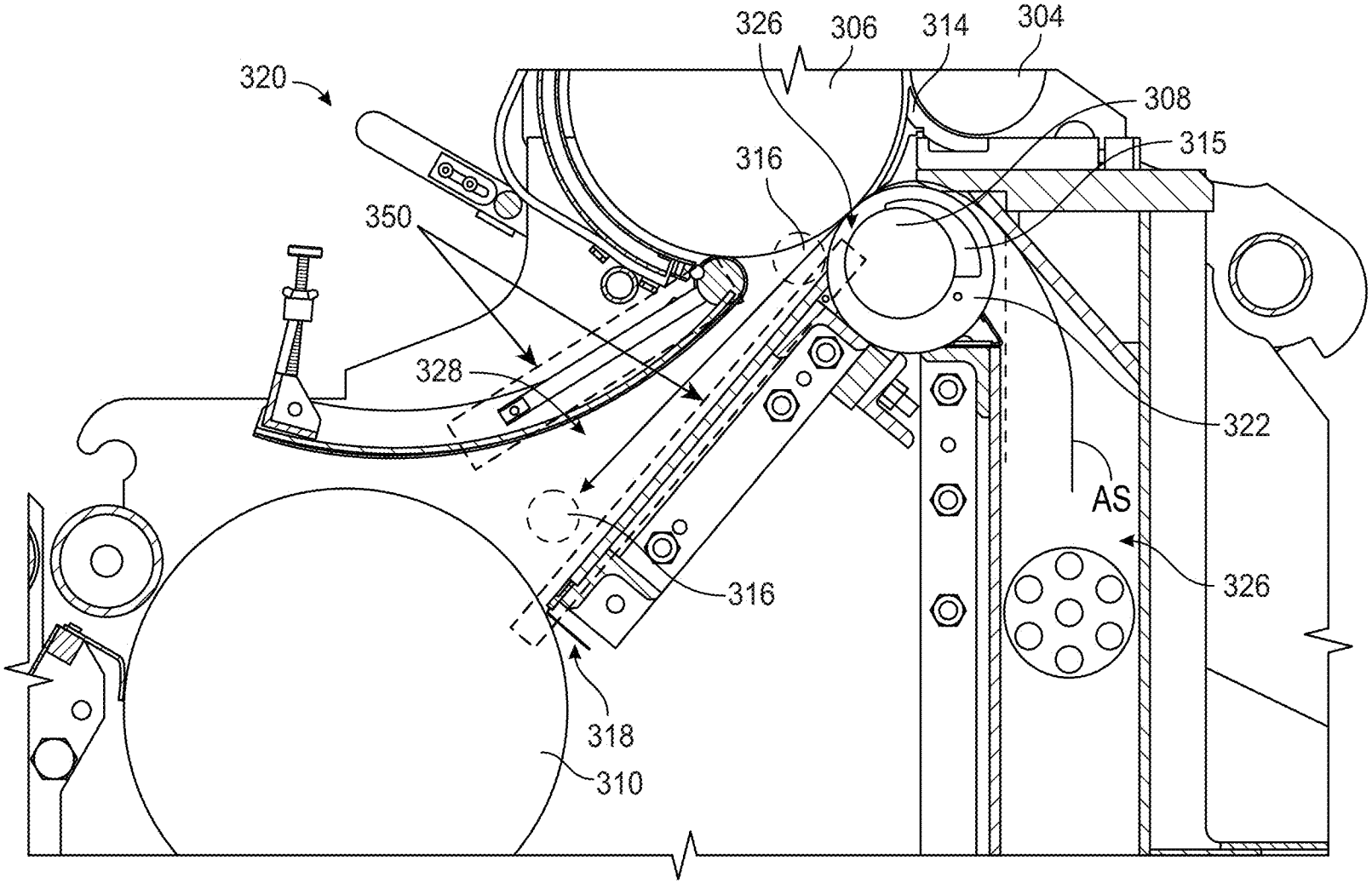

FIG. 3B illustrates a machine 320 having an air supply AS, a feed apparatus (e.g., rotatable feed roll 304), a lickerin (e.g., lickerin roll 306) a saber (e.g., saber roll 308), a channel 326 including a space 328 and the collector 310. The rotatable lickerin roll 306 can be configured to remove a plurality of fibers from a fibrous mat delivered to adjacent the lickerin roll 306 by the feed roll 304. The lickerin roll 306 can be configured to doff the plurality of fibers from the lickerin roll 306. The rotatable saber roll 308 can be positioned adjacent the feed roll 304 and the lickerin roll 306. The channel 326 can communicate the air supply AS to the space 328 defined between the lickerin roll 306 and the saber roll 308. The space 328 can include a doffing location where the doff of the plurality of fibers from the lickerin roll 306 occurs. The rotatable collector 310 can be positioned to capture the plurality of fibers once doffed into the air supply AS. The plurality of fibers when laid-up form the random fiber web on the collector 310.

The embodiment of FIG. 3B shows the nose bar assembly 314 positioned adjacent the lickerin roll 306 and extending along the lickerin roll 306 toward the saber roll 308 for the machine 320. FIG. 3B additionally shows the vent 315 in the saber roll end cap 322 adjacent the lickerin roll 306 for the machine 320. As the saber roll end cap 322 can be moveable in the side housing, the position of the vent 315 can be changed relative to the lickerin roll 306. FIG. 3B shows the one or more viewing ports 316 in the side housing of the machine 320. The one or more viewing ports 316 can be positioned adjacent the doffing location (e.g., adjacent the lickerin roll 306) and adjacent the collector 310. The apparatus 320 can include the reverse seal 318 that is shaped to extend from the lower slide plate 324 to engage with the collector 310. The reverse seal 318 can be oriented with a tip that extends generally in a direction opposite of a direction of rotation of the collector 310.

The embodiments of FIGS. 3A and 3B both illustrate embodiments where fibers are doffed into air supply AS and thrown toward a collector. In between the entrained fibers move through a housing with chamber barriers highlighted by boxes 250. Contact with any of these chamber barriers can reduce a velocity of a moving fiber to zero, reduce the overall acceleration of the fiber, and cause it to intertwine with nearby fibers, creating a clump that will result in an area of a resulting web of higher fiber density than desired. In some embodiments, such as those illustrated in FIGS. 4-5, chamber barriers create a wider path for air flow through a machine, such that entrained fibers are more likely to move along a path directly from a doffing location to a collector without encountering an obstacle. The present inventors have determined the various channel designs described herein are configured to more evenly spread the air supply AS across the respective channel with the plurality of fibers entrained therein prior to the air supply reaching a collector. This allows for a more even cross-web deposition on the collector when forming the random fiber web.

Figure 4:
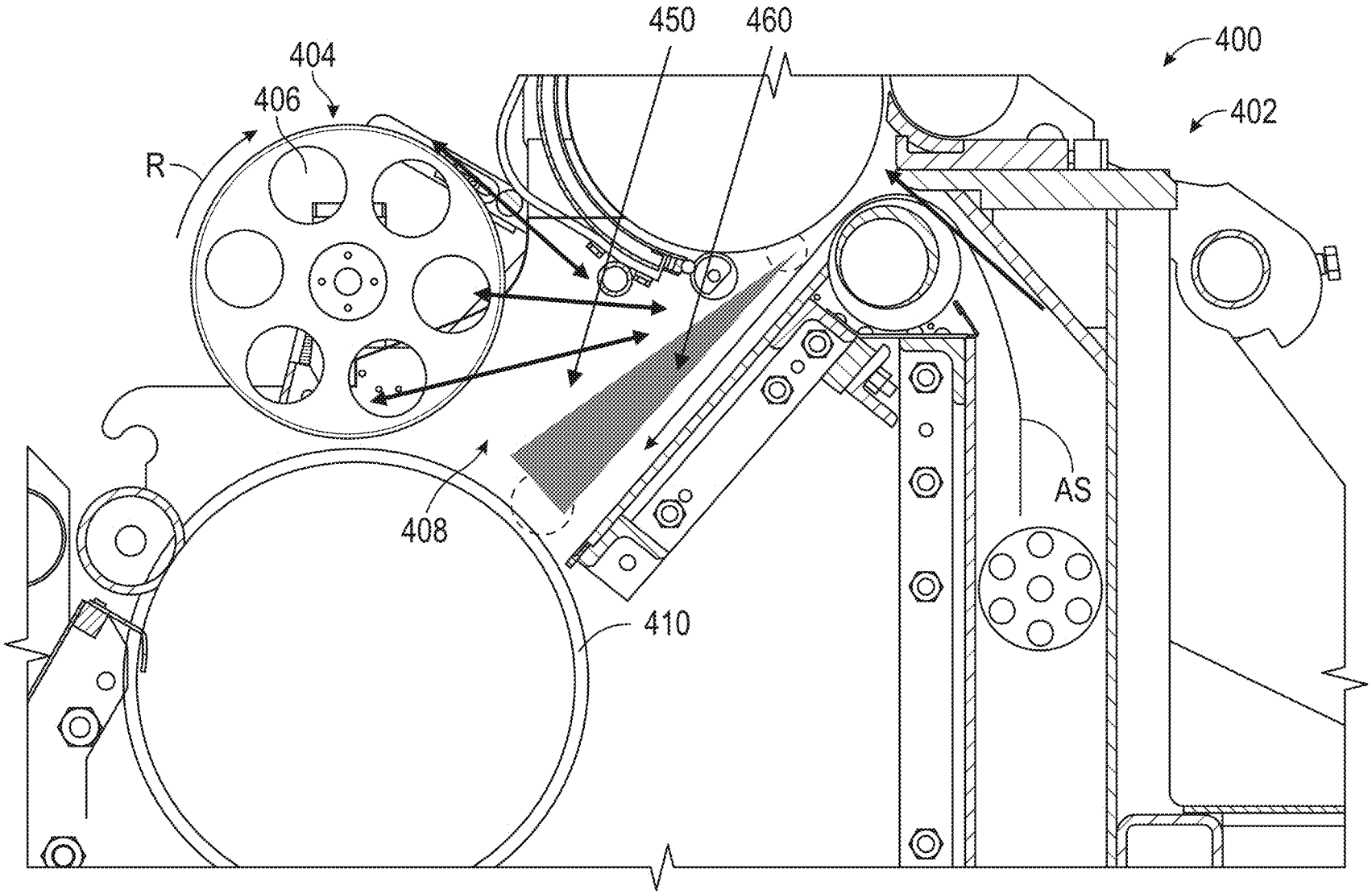
FIG. 4 is a schematic cross-section of a portion of a second machine for forming a random fiber web according to an embodiment of the present disclosure.

FIG. 4 shows an embodiment of a system 400 that is part of a machine 402 that includes a drum 404. In FIG. 4, the doffer plate has been replaced by the drum 404. The drum 404 can spaced from the lickerin roll and can be positioned adjacent the collector 414. The drum 404 can include one or more passages 406 that communicate (for example, via openings through the cylindrical wall of drum 404) with a channel 408 that provides for passage of the air supply AS with the plurality of fibers entrained therein downstream of the doffing location to the collector 410. The one or more passages 406 are configured to allow an amount of the air supply AS to pass therethrough should conditions within the system 400 and machine 402 dictate. Alternatively, the one or more passages are configured to allow an ambient air from outside the machine 402 to pass therethrough and into the channel 408.

The drum 404 can, in some embodiments, provide a moving surface and can be configured to move relatively closer or further away from the collector 410 to change the size and shape of the channel 408 (which is partially defined by the drum 404). The drum 404 can rotate as indicated by arrow R in FIG. 4. Such rotation can be the result of passage of the ambient air or the air supply AS in some embodiments. In other embodiments, the drum 404 can be powered to facilitate the rotation shown by the arrow R. Although the drum 404 is specifically shown in FIG. 4 other embodiments can contemplate a plate, nip, belt, roll, etc. or another type of apparatus that can change position to change the size and shape of the channel 408. In yet further embodiments, no apparatus (e.g., no housing, plate, nip, drum, belt, roll, etc.) may be provided such that the channel 808 is open to the ambient in the location where the drum would be for free flow and exchange of air to or from the air supply AS.

Figure 5:
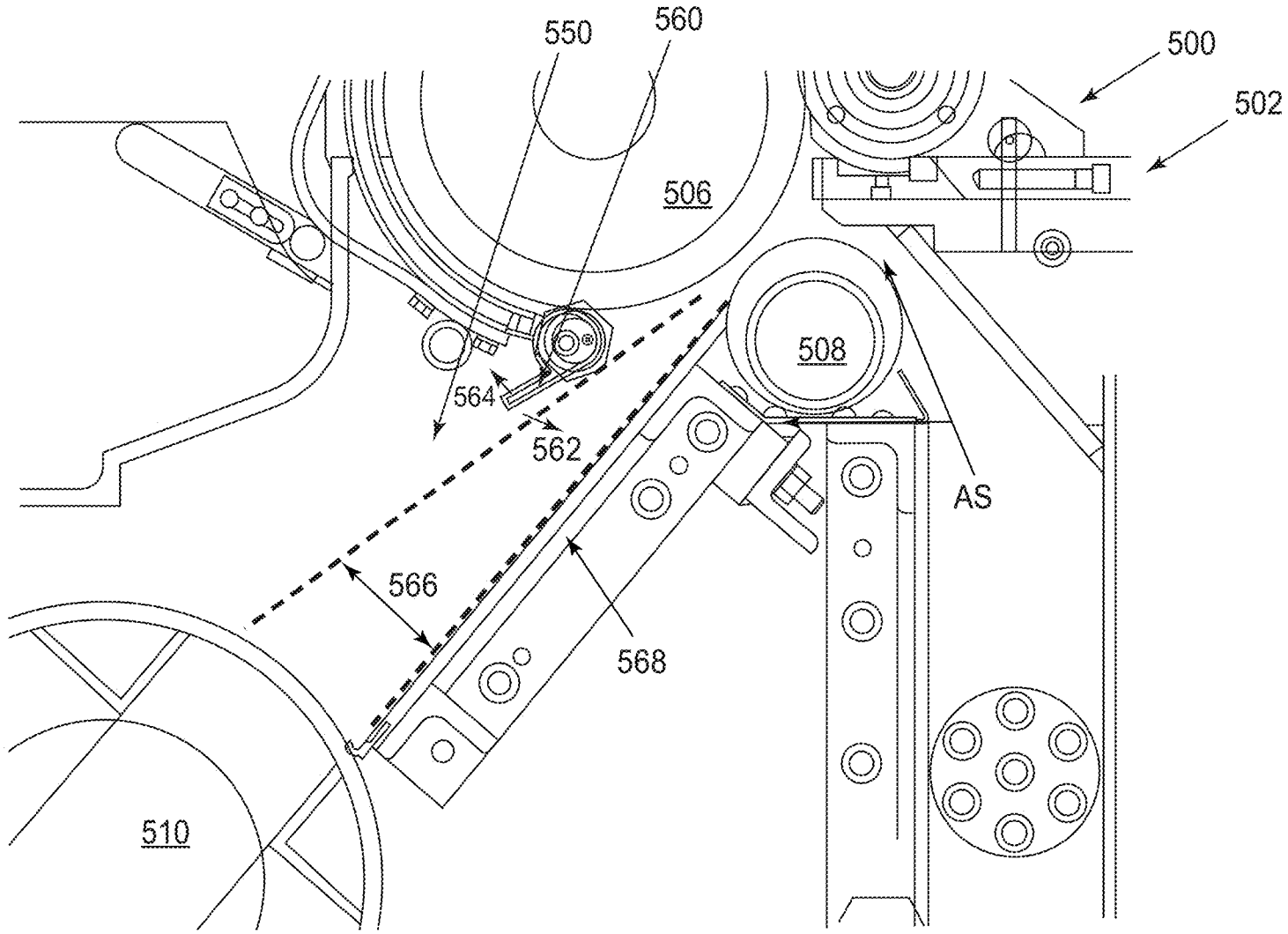
FIG. 5 is a schematic cross-section of a portion of a third machine for forming a random fiber web according to an embodiment of the present disclosure.

FIG. 5 shows an embodiment of a system 500 that is part of a machine 502 that includes a dynamic air control mechanism 560, which is illustrated in FIG. 5 as a rotatable doffing bar extension 560 that can rotate in the directions indicated by arrows 562, 564. In one embodiment, doffing bar extension 560 may have a functional rotational range of more than 30°, more than 60°, more than 90°, more than 120°, or even more than 150°. In some embodiments, the doffing bar extension 560 may be physically able to rotate further but does not provide a significant functional benefit. Altering a position of the extended doffing bar 560 influences the flow of air from AS through chamber 550. By altering a position of doffing bar 560 and a position of lower slide plate 568, an air flow path 566 can be influenced, allowing for better control of entrained fibers, and better consistency in the cross-web direction as fibers contact collector 510.

Doffing bar 560 is illustrated in FIG. 5 as extending only part of the distance between lickerin roll 506 and collector 510. In some embodiments, doffing bar extends at least 5%, or at least 10%, or at least 15%, or at least 20%, or at least 25%, or at least 30%, or at least 35%, or at least 40%, or at least 45% of the distance between lickerin roll 506 and collector 510. In some embodiments, doffing bar extends further, more than 50%, more than 55%, more than 60%, more than 65%, more than 70%, more than 75%, more than 80%, more than 85%, or more than 90% of the distance between lickerin roll 506 and collector 510.

Additionally, doffing bar 560 is illustrated as having a straight bar extending from a rotating portion. However, in some embodiments, the straight portion may be curved, either curved toward slide plate 568 or away from slide plate 568.

The full perimeter of chamber 550 is not illustrated in FIG. 5. System 500 may be combined with an upper drum, such as drum 404 of FIG. 4, in some embodiments, which may also allow for better control of air and entrained fiber movement within flow path 550. Alternatively, in some embodiments a doffing plate, such as plate 20 of FIG. 1, may provide for an upper boundary on chamber 550. The upper boundary may also be a standard glass or metal housing, in other embodiments. These and other suitable configurations are expressly contemplated. Other static and dynamic air control mechanisms may also be used in combination with the extended doffing bar 560, such as any of those discussed herein, or in PCT Patent Application Ser. No. US2019/045603 (based on U.S. Provisional Patent Application 62/717,069), or in PCT Patent Application Ser. No. US2019/045604 (based on U.S. Provisional Patent Application 62/717,095). For example, position of a lower slide plate or a saber roll with respect to the lickerin roll.

Figure 6:
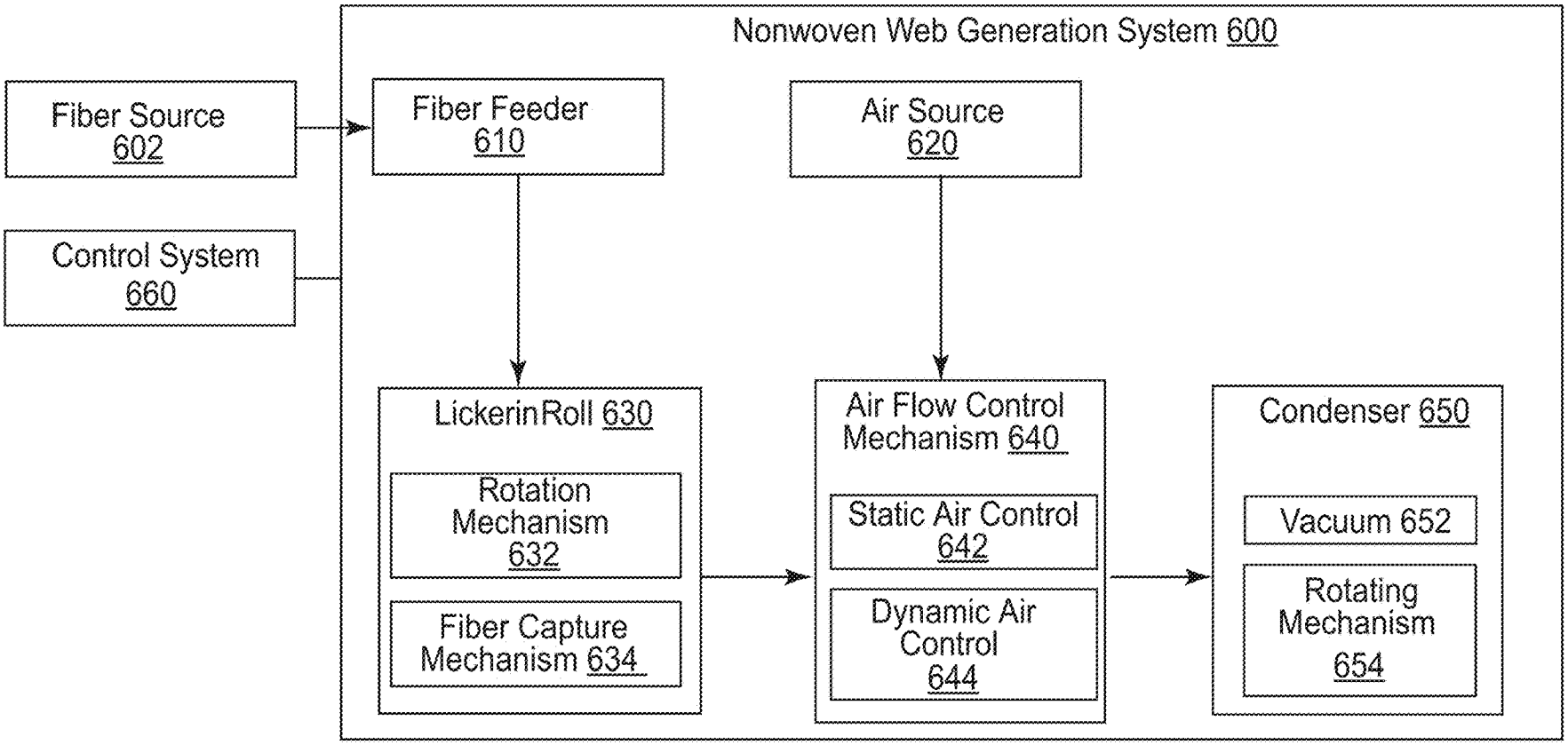
FIG. 6 is a component diagram of a fourth machine for forming a random fiber web according to an embodiment of the present disclosure.

FIG. 6 illustrates a component diagram of a nonwoven web generation system 600. System 600 includes a fiber source 602, which provides fibers to a fiber feeder 610. Lickerin roll 630 retrieves fibers from fiber feeder 610 using a fiber capture mechanism 634. Lickerin roll 630, in one embodiment, is a rotating lickerin roll 630, which rotates using a rotation mechanism 632. Lickerin roll 630 doffs fibers, which are entrained in an air flow provided from air source 620, and collected by a condenser 650. Vacuum 652 pulls fibers into place along a crossweb direction on condenser 650, which rotates using rotating mechanism 654.

Air flow, from air source 620, is controlled using air flow control mechanism 640. Air flow control mechanism 640 may include a static air control 642 which, as used herein, is intended to describe a controller 642 that is generally not adjusted in between operations, but remains in a set operational position during an operation. Air flow control mechanism 640 may, in some embodiments, be a dynamic air control mechanism 644 that can be adjusted in between operations. Dynamic air control mechanisms 644 may also be adjustable during an operation, in some embodiments, however in-situ adjustments may not be recommended for safety reasons. Positions, movements and speed of movement, for example rotational speed of lickerin roll or condenser 650, may be controlled by a control system 660, which may be part of nonwoven web generation system 600, or may be connected to nonwoven web generation system 600 through a wired or wireless connection, in some embodiments.

Figure 7A:
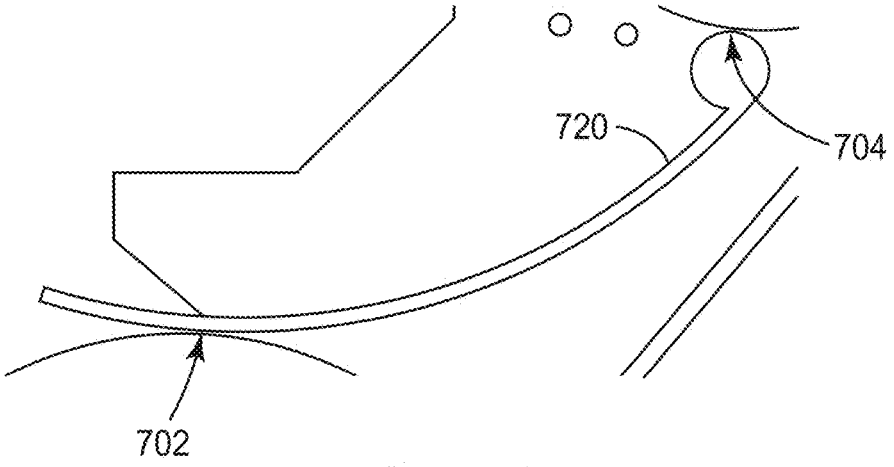
FIG. 7A-7D illustrate views of a doffing plate and an extended doffing bar for controlling airflow according to an embodiment of the present invention.
Figure 7B:
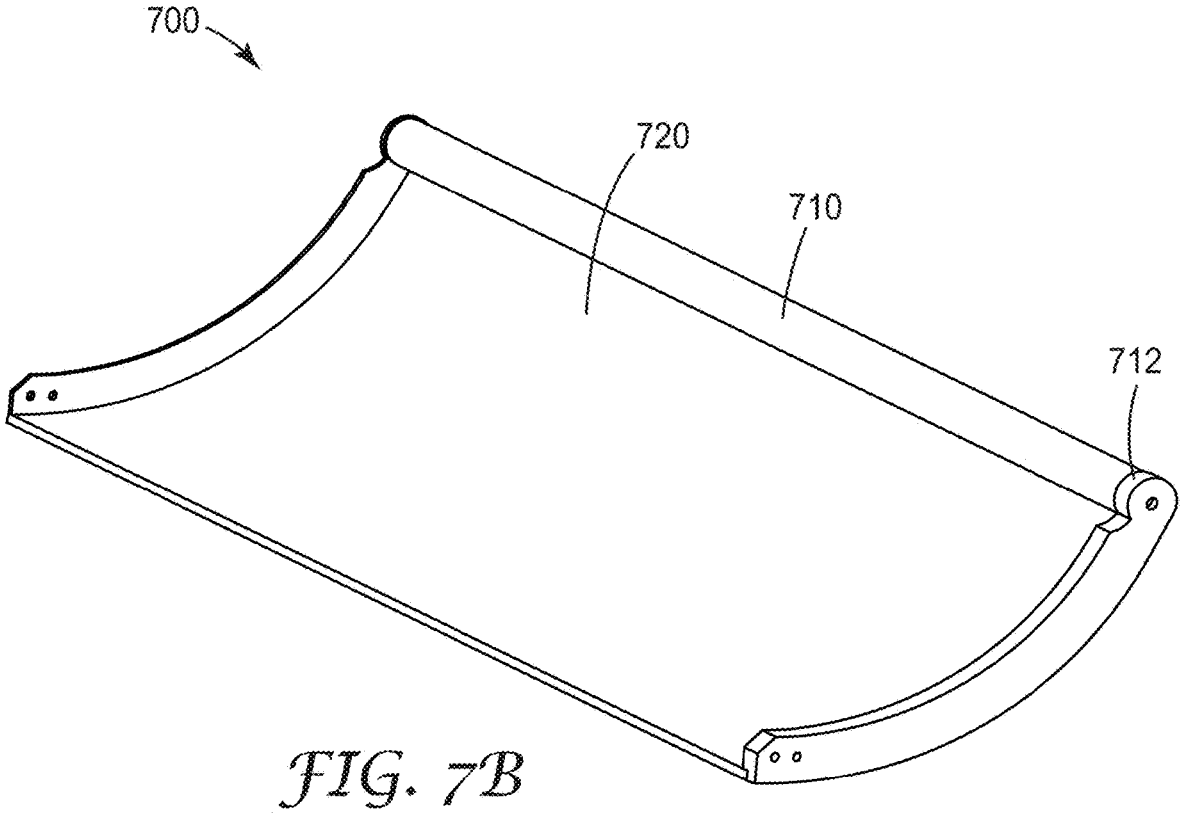

FIG. 7A-7D illustrate views of a doffing plate and an extended doffing bar for controlling airflow according to an embodiment of the present invention. FIGS. 7A and 7B illustrate views of a prior art doffing plate, for example plate 20 from FIG. 1. Doffing plate 720, as used in prior art machines, creates an upper boundary of an air flow chamber. As illustrated in FIG. 7A, doffing assembly 700 includes a doffing plate 720 has curvature and extends from a point 704, where it connects to a lickerin roll, to point 702, where it connects to a fiber collector. Doffing plate 720 connects to a doffing bar 710 that is at a fixed position 712 during operation of a system. Doffing plate 720 is intended have some rotation such that a gap is formed at point 702, through which a formed fiber web passes through. The formed fiber web closes the gap created left by doffing plate 720. While doffing plate 720 may rotate several degrees, less than 10° or less than 15°, for example, any gap created is intended to be sealed by a fiber web formed during operation of assembly 700. Additionally, as described above, doffing plate 720 presents some issues with regard to free air flow from a doffing location to a collector.

Figure 7C:
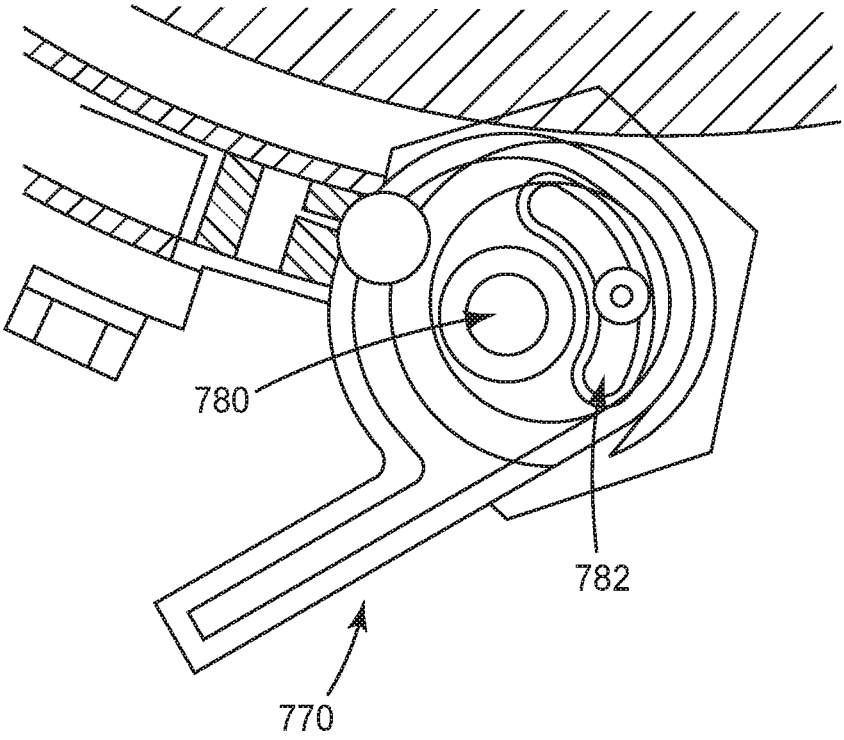
Figure 7D:
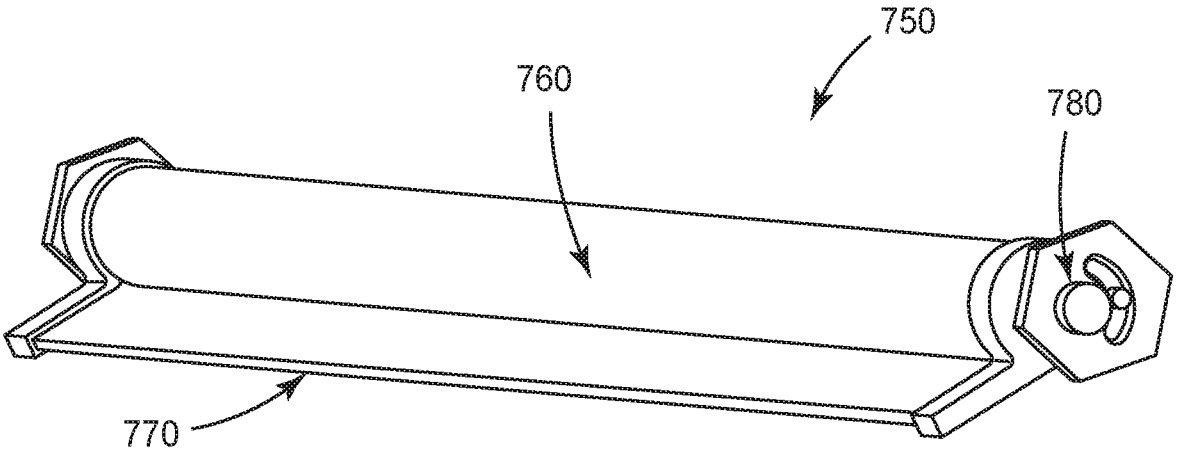

In contrast, FIGS. 7C and 7D illustrate views of an extended doffing bar assembly 750. As illustrated in FIG. 7C, an extending portion 770 extends from a doffing bar 760, which is fixed within the system during operation. However, extending portion 770 is rotatable about a rotation axis 780. As illustrated in FIGS. 7C and 7D, in some embodiments rotation is limited by a rotation path 782, which may include a range of about 150° about rotation axis 780. However, in other embodiments the rotation range may be larger, for example limited only by the position of doffing bar 760 and a lickerin roll, or the rotation range may be smaller. For example, the rotation range may be as small as 30°, or 40°, or 50°, or 60°, or 70°, or 80°, or 90°, or 100°, or 110°, or 120°, or 130° or 140°. Additionally, the rotation range may be larger than 140°, or larger than 150°. The rotation angle can also be expressed with respect to a 0° position where doffing bar 760 is positioned parallel to the slide plate. The rotation range, for example, can be between 0° to 30°, or more, in the direction toward the slide plate, or between 0° and 60°, or more in the direction away from the slide plate.

In the embodiments of FIGS. 7C and 7D, extended doffing bar assembly 750 does not perform a sealing or upper boundary function. A separate boundary may also be included, in some embodiments. In some embodiments, the separate boundary is porous or otherwise configured to allow airflow between an air flow channel and the ambient environment.

A method of forming a random fiber web using pneumatic fiber feeding system is presented. The method includes providing a plurality of moveable apparatuses including a lickerin and a feeder. The lickerin is configured to remove a plurality of fibers from a fibrous mat delivered to adjacent the lickerin by the feeder. The method also includes doffing the plurality of fibers from the lickerin at a doffing location within the system. The method also includes communicating an air supply to entrain the plurality of fibers with the air supply after the doffing. The method also includes controlling the air supply within a flow path between the lickerin and a collector. The method also includes collecting the plurality of fibers from the air supply on a collector to form the random fiber web.

Controlling the air supply within the flow path may include a static air control mechanism.

The static air control mechanism may include a vent in the saber assembly, the chamber, a doffer plate, or a lower slide plate The static air control mechanism may include an extended nose bar between the feeder and the lickerin.

The static air control mechanism may include a reverse seal extending from a lower slide plate to the collector.

The static air control mechanism may include a drum that allows exchange between the air supply and an ambient air source.

The drum may rotate.

The static air control mechanism may include an air deflector plate.

Controlling the air supply within the flow path may include a dynamic air control mechanism.

The dynamic air control mechanism may be adjustable only when the pneumatic fiber feeding system is in a nonrunning state.

The dynamic air control mechanism may include an extended doffer bar.

The extended doffer bar may be rotatable within a chamber of the pneumatic fiber feeding system. Rotation of the extended doffer bar causes the air supply to change from a first air flow pattern within the chamber to a second air flow pattern within the chamber.

The dynamic air control mechanism comprises an air foil positioned to direct the air supply.

The method may further include controlling the amount of the air supply to at least one of the doffing location and downstream of the doffing location as defined by a direction of flow of the air supply.

Controlling the amount of air supply may include providing for one or more of a damper, a nose bar extension, an air deflector plate, an airfoil and one or more passages in a housing of the system.

A pneumatic fiber feeding system for forming a random fiber web is presented. The system includes a feeder. The system also includes a lickerin configured to remove a plurality of fibers from a fibrous mat delivered to adjacent the lickerin by the feeder and configured to doff the plurality of fibers from the lickerin. The system also includes a channel communicating an air supply to a space adjacent the lickerin, the space including a doffing location where the doff of the plurality of fibers from the lickerin occurs. The system also includes a collector positioned to capture the plurality of fibers once doffed into the air supply, the plurality of fibers forming the random fiber web on the collector.

The system also includes an air control mechanism within the channel.

The air control mechanism may be a static air control mechanism.

The air control mechanism may be a dynamic air control mechanism.

The static air control mechanism may include a vent in the saber assembly, the chamber, a doffer plate, or a lower slide plate.

The static air control mechanism may include an extended nose bar between the feeder and the lickerin.

The static air control mechanism may include a reverse seal extending from a lower slide plate to the collector.

The static air control mechanism may include a drum that allows exchange between the air supply and an ambient air source.

The drum may include an upper condenser.

The upper condenser may rotate.

The static air control mechanism may include an air deflector plate.

The dynamic air control mechanism may include an extended doffer bar.

The extended doffer bar may be rotatable within a chamber of the pneumatic fiber feeding system. Rotation of the extended doffer bar causes the air supply to change from a first air flow pattern within the chamber to a second air flow pattern within the chamber.

The channel downstream of the doffing location may be defined by a direction of flow of the air supply that is partially formed by a first plate. The first plate has a substantially planar surface along a channel interfacing extent thereof that is configured to substantially align with the direction of flow of the air supply.

A first end of the first plate extends beyond the extended doffer bar to adjacent the lickerin.

The system may also include one or more passages that communicate with the channel downstream of the doffing location. The one or more passages may be configured to allow both an amount of the supply air to pass therethrough and allow an amount of an ambient air to pass therethrough and into the channel.

The one or more passages may be formed by a portion of a housing enclosing the channel.

The system lay further include a deflector plate positioned adjacent the lickerin and extending into the space. The deflector plate may be positioned to keep the air supply and the plurality of fibers separated until after the doffing location.

The system may further include a nose bar assembly positioned between the lickerin and the deflector plate. The nose bar assembly may be configured to extend the doffing location past the feed roll and into a second space defined between lickerin and the deflector plate.

The system may further include an airfoil positioned in the channel that is configured to be selectively moveable toward and away from the deflector plate to selectively allow for passage of at least a portion of the supply air into the second space.

The system may further include a damper positioned in the channel and configured to be selectively moveable toward and away from a saber roll to selectively allow for passage of at least a portion of the supply air around a part of the saber roll that does not interface with the lickerin.

A pneumatic fiber feeding system for forming a random fiber web is presented. The system includes a plurality of moveable apparatuses including a lickerin and a feeder. The lickerin is configured to remove a plurality of fibers from a fibrous mat delivered to adjacent the lickerin by the feeder. The lickerin is configured to doff the plurality of fibers from the lickerin. The system also includes a channel communicating an air supply to a space adjacent the lickerin, the space including a doffing location where the doff of the plurality of fibers from the lickerin occurs. The system also includes a collector positioned to capture the plurality of fibers once doffed into the main air supply, the plurality of fibers forming the random fiber web on the collector. The system also includes an air control mechanism within the channel.

The system may also include a drum, one or more passages that communicate with the channel downstream of the doffing location, or a restriction in the channel downstream of the doffing location and prior to the collector.

The air control mechanism may direct the air supply toward the collector.

The air control mechanism may be adjustable.

The air control mechanism may be rotatable.

The air control mechanism may extend within the channel toward the collector.

Adjusting the air control mechanism may change a flow path of the air supply through the channel.

The air control mechanism may extend less than halfway between the lickerin and the collector.

The air control mechanism may extend more than halfway between the lickerin and the collector.

The air control mechanism may include an extending portion that is substantially flat.

The air control mechanism may include an extending portion that is curved.

The air control mechanism may extend from a doffing bar and rotates about an axis defined by the doffing bar.

The system may also include a deflector plate positioned adjacent the lickerin and extending into the space. The deflector plate may be positioned to keep the air supply and the plurality of fibers separated until after the doffing location.

The system may also include a nose bar assembly positioned between the lickerin and the deflector plate. The nose bar assembly may be configured to extend the doffing location past the feed roll and into a second space defined between lickerin and the deflector plate.

The system may also include an airfoil positioned in the channel. The airfoil may be configured to be selectively moveable toward and away from the deflector plate to selectively allow for passage of at least a portion of the supply air into the second space.

The system may also include a damper positioned in the channel and configured to be selectively moveable toward and away from a saber roll to selectively allow for passage of at least a portion of the supply air around a part of the saber roll that does not interface with the lickerin.

The system may also include a passage between the channel and a source of an ambient air.

As Used Herein:

The term "a", "an", and "the" are used interchangeably with "at least one" to mean one or more of the elements being described.

The term "and/or" means either or both. For example, "A and/or B" means only A, only B, or both A and B.

The terms "including," "comprising," or "having," and variations thereof, are meant to encompass the items listed thereafter and equivalents thereof as well as additional items.

The term "adjacent" refers to the relative position of two elements, such as, for example, two layers, that are close to each other and may or may not be necessarily in contact with each other or that may have one or more layers separating the two elements as understood by the context in which "adjacent" appears.

All scientific and technical terms used herein have meanings commonly used in the art unless otherwise specified. The definitions provided herein are to facilitate understanding of certain terms used frequently in this application and are not meant to exclude a reasonable interpretation of those terms in the context of the present disclosure.

Unless otherwise indicated, all numbers in the description and the claims expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviations found in their respective testing measurements.

The term "substantially" means within 20 percent (in some cases within 15 percent, in yet other cases within 10 percent, and in yet other cases within 5 percent) of the attribute being referred to. Thus, a value A is "substantially similar" to a value B if the value A is within plus/minus one or more of 5%, 10%, 20% of the value A.

Features and advantages of the present disclosure will be further understood upon consideration of the detailed description as well as the appended claims.

The recitation of numerical ranges by endpoints includes all numbers subsumed within that range (e.g. a range from 1 to 5 includes, for instance, 1, 1.5, 2, 2.75, 3, 3.80, 4, and 5) and any range within that range.

Although the present disclosure has been described with reference to preferred embodiments, workers skilled in the art will recognize that changes can be made in form and detail without departing from the spirit and scope of the present disclosure.

What is claimed is:

1. A method of forming a random fiber web using a pneumatic fiber feeding system, the method comprising:

providing a plurality of moveable apparatuses including a lickerin and a feeder, the lickerin configured to remove a plurality of fibers from a fibrous mat delivered to the lickerin by the feeder;

doffing the plurality of fibers from the lickerin at a doffing location within the system;

communicating an air supply to entrain the plurality of fibers with the air supply after the doffing;

controlling the air supply within a flow path between the lickerin and a collector, wherein the controlling comprises providing a rotatable doffing bar, the rotatable doffing bar extending, from a pivot point adjacent the lickerin, for a portion of a distance between the lickerin and the collector, wherein controlling comprises allowing an ambient air from outside the pneumatic fiber feeding system to pass into the flow path; and collecting the plurality of fibers from the air supply on the collector to form the random fiber web.

2. The method of claim 1, wherein the rotatable doffing bar has a functional rotational range of more than 30°.

3. The method of claim 1, wherein rotation of the rotatable doffing bar alters the flow path of the air supply.

4. The method of claim 1, wherein the rotatable doffing bar does not perform a sealing function or form an upper boundary of an air flow chamber comprising the flow path.

5. The method of claim 1, wherein the flow path is defined by a housing, the housing comprising a first chamber barrier and a second chamber barrier, wherein the second chamber barrier comprises a slide plate, and wherein the first chamber barrier is configured to allow airflow between the flow path and an ambient environment.

6. The method of claim 1, wherein rotation of the rotatable doffing bar causes the air supply to change from a first air flow pattern within a chamber comprising the flow path to a second air flow pattern within the chamber.

7. The method of claim 1, wherein the rotatable doffing bar may have a functional rotational range of more than 60°.

8. The method of claim 1, and further comprising controlling the amount of the air supply to at least one of the doffing location and downstream of the doffing location by providing for one or more of a damper, a nose bar extension, an air deflector plate, an airfoil and one or more passages in a housing of the system.

9. The method of claim 5, wherein the first chamber barrier comprises an upper drum, the upper drum comprising a passage configured to allow an amount of the air supply to pass through or configured to allow ambient air to pass into the flow path.

* * * * *